US007124599B2

(12) United States Patent
Jung et al.

(10) Patent No.: US 7,124,599 B2
(45) Date of Patent: Oct. 24, 2006

(54) ABSORPTION PIPE STRUCTURE OF COMPRESSOR

(75) Inventors: In Hwa Jung, Seoul (KR); Jungwoo Lee, Seoul (KR); Seong Won Bae, Seoul (KR); Sim Won Chin, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 88 days.

(21) Appl. No.: 10/943,104

(22) Filed: Sep. 17, 2004

(65) Prior Publication Data

US 2005/0178140 A1 Aug. 18, 2005

(30) Foreign Application Priority Data

Feb. 16, 2004 (KR) ..... 10-2004-0010077

(51) Int. Cl.
*F25D 19/00* (2006.01)

(52) U.S. Cl. ..... 62/296; 62/324.6; 181/403

(58) Field of Classification Search ..... 62/295–296, 62/324.1–324.6; 181/403; 417/312
See application file for complete search history.

(56) References Cited

U.S. PATENT DOCUMENTS

| | | | | |
|---|---|---|---|---|
| H1317 | H * | 6/1994 | Ng | 181/207 |
| 5,775,120 | A * | 7/1998 | Inazuka et al. | 62/259.1 |
| 6,216,817 | B1 * | 4/2001 | Kannon et al. | 181/296 |
| 6,260,373 | B1 * | 7/2001 | Rockwood | 62/295 |

* cited by examiner

*Primary Examiner*—William E. Tapolcai
(74) *Attorney, Agent, or Firm*—Greenblum & Bernstein, P.L.C.

(57) ABSTRACT

An absorption pipe structure of a compressor, capable of reducing vibration of the absorption pipe and making the machinery room small-sized, by making short the length of the absorption pipe connected with the compressor and forming the curved part formed in a proper diameter, is provided.

20 Claims, 4 Drawing Sheets

ABSORPTION PIPE STRUCTURE OF COMPRESSOR

BACKGROUND OF THE INVENTION

1. Field of the Invention

The present invention relates to an absorption pipe of a compressor, and more particularly, to an absorption pipe structure of the compressor that can improve noise and vibration occurring at the compressor and an outdoor unit of an air conditioner by improving a structure of an absorption pipe, which is an absorption conduit line to the compressor and is formed on the outdoor unit of the air conditioner.

2. Description of the Related Art

Generally, an air conditioner, which is an apparatus for lowering down an indoor temperature by discharging to the inside a cooling air generated through compression, condensation, expansion, and evaporation of a refrigerant, is roughly divided into an outdoor unit installed in the outside and an indoor unit installed in the inside. More specifically, the air conditioner is an apparatus for maintaining an air of the inside at an appropriate temperature and humidity, by having heat exchange performed at the outdoor unit and heat exchange performed again at the indoor unit.

In the meantime, in case of the air conditioner having functions of both a heater and a cooler, the outdoor unit includes the compressor, a four-way valve, an outdoor heat exchanger, an outdoor fan, and an expansion valve, to perform heat exchange. The four-way valve switches a flowing direction of a refrigerant into a forward direction or a reverse direction, thereby having the air conditioner selectively operate as a heater or a cooler depending on cases.

In the meantime, the noise from the outdoor unit is roughly divided into a noise occurring during operation of the outdoor fan and a noise occurring during operation of the compressor. The present invention is mainly directed to improve a noise occurring during operation of the compressor. The nose at the compressor occurs in form of rotational and translational motions of the compressor, and is generally transferred through the pipe connected to the compressor. Particularly, the noise occurring at the compressor is transferred to an absorption side of the compressor and particularly intense and big noise is propagated through an absorption pipe of high stiffness and severe eccentricity. Also, though the absorption pipe is formed long in its length compared with other pipe, to reduce delivering force of the pipe, there is a problem that more big vibration of the absorption pipe is caused by resonance due to the long length of the absorption pipe.

Also, generally, to reduce delivering force propagated through the absorption pipe, the absorption pipe is looped long in up-down direction. Thanks to the looped absorption pipe, an effect of reducing delivering force of vibration occurring at the compressor can be obtained, but the vibration has been amplified even more by resonance. An attempt for improving the absorption pipe to achieve above two objects of reduction in delivering force of such vibration and suppression of amplification of vibration due to resonance has not been made up to now.

In case the compressor such as a rpm (revolution per minute)-variable-type compressor where vibration of various frequencies occurs is used for the compressor installed in the outdoor unit, a resonance phenomenon of the absorption pipe may be amplified even more due to the vibration of various frequencies, therefore, vibration and noise of the absorption pipe emerges as a more serious problem.

Also, in case vibration is concentrated on the absorption pipe, fatigue at the absorption pipe is accumulated and destruction occurs frequently.

SUMMARY OF THE INVENTION

Accordingly, the present invention is directed to an absorption pipe structure of a compressor that substantially obviate one or more problems due to limitations and disadvantages of the related art.

An object of the present invention to provide an absorption pipe structure of a compressor that can reduce vibration and noise at the absorption pipe of the compressor by properly suggesting a shape and a length of the absorption pipe of the compressor, connected to an absorption side of the compressor.

Another object of the present invention is to provide an absorption pipe structure of a compressor that can reduce the manufacturing costs of an absorption pipe by designing the absorption pipe in a short length as much as possible, with optimized value capable of suppressing vibration transferred from the compressor.

Still another object of the present invention is to provide an absorption pipe structure of a compressor that can construct an outdoor unit in a compact way on the whole, e.g., reduce a size of the outdoor unit by manufacturing the absorption pipe in a relatively small scale.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims thereof as well as the appended drawings.

To achieve these objects and other advantages in accordance with the purpose of the invention, as embodied and broadly described herein, there is provided an absorption pipe structure of a compressor, including: a compressor where vibration occurs; a four-way valve for switching between a cooling and a heating operations of an air conditioner; and an absorption pipe for getting a refrigerant to flow into the compressor from the four-way valve, more than one place of which is looped, and a height of a lowest end of which is positioned at a place which corresponds to one third of the whole height of the compressor.

In another aspect of the present invention, there is provided an absorption pipe structure of a compressor, including: a compressor for compressing a refrigerant; a refrigerant supplying part for supplying a refrigerant to the compressor; and an absorption pipe for connecting the compressor with the refrigerant supplying part, wherein at least more than one part is looped and a diameter of a curved part at the looped part is less than three times that of the pipe.

In still another aspect of the present invention, there is provided an absorption pipe structure of a compressor, including: a compressor for compressing a refrigerant; a refrigerant supplying part for supplying a refrigerant to the compressor; and an absorption pipe for connecting the compressor with the refrigerant supplying part, wherein at least more than one part is looped and on a portion directly connected to the compressor, a straight pipe part whose length is less than four times the pipe's diameter is formed.

According to the present invention, the whole vibration occurring at the outdoor unit can be reduced even more and the outdoor unit can be made small even more.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
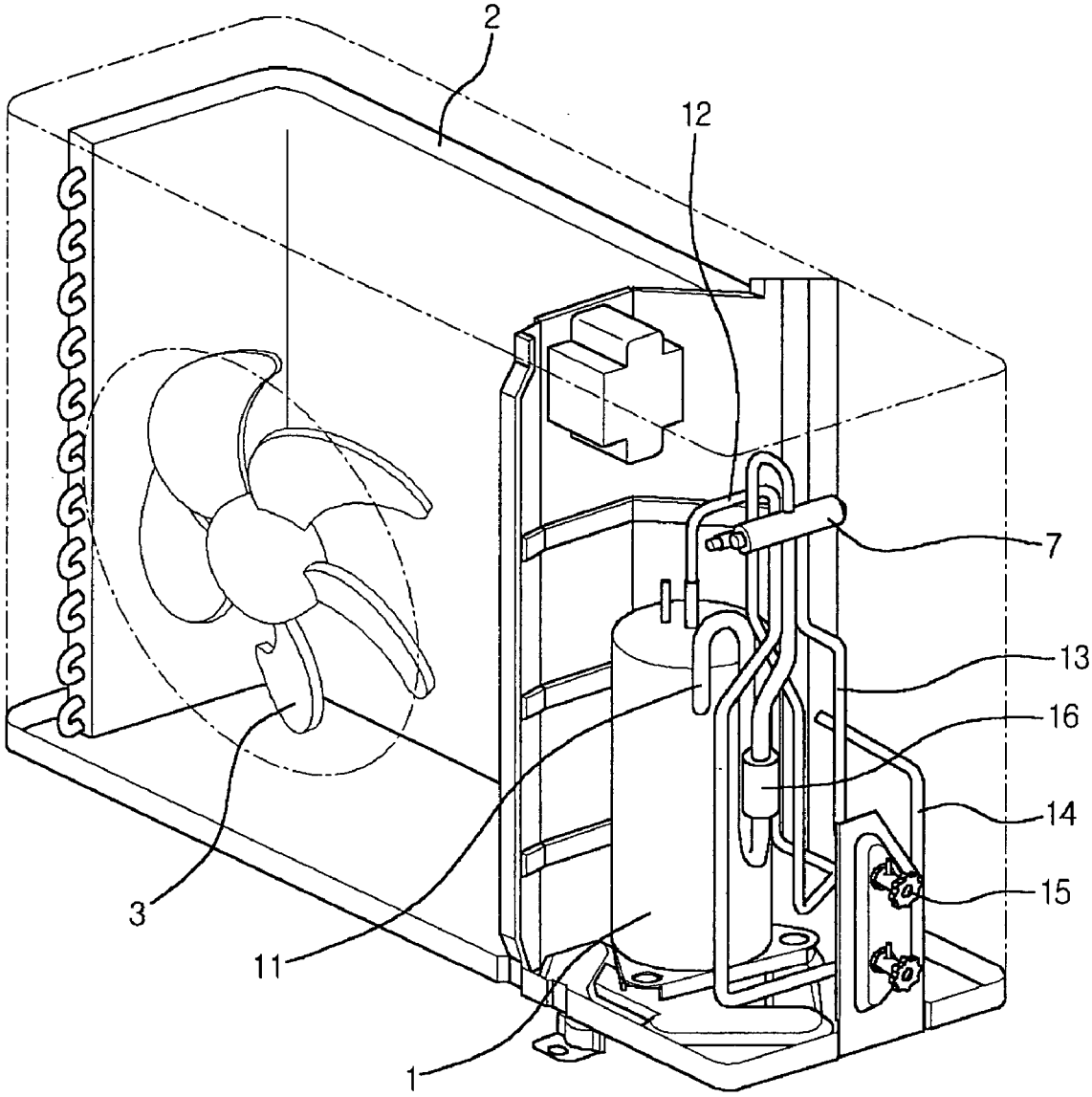
FIG. 1 is a perspective view of an inside of the outdoor unit according to the present invention.

FIG. 1 is a perspective view of an inside of the outdoor unit according to the present invention.

Referring to FIG. 1, the outdoor unit of the present invention includes for its inner construction: a compressor 1 for compressing a refrigerant; an outdoor heat exchanger 2 for exchanging heat of a refrigerant flowing in the inside; an outdoor fan 3 for forcibly sending an air to the outdoor heat exchanger 2; a four-way valve 7 for switching a flowing direction of a refrigerant; an absorption pipe 11 for connecting the compressor 1 with the four-way valve 7 so that a refrigerant may be absorbed into the compressor 1; a discharging pipe 12 for discharging a refrigerant compressed by the compressor 1; an indoor-connection pipe 13 for connecting the four-way valve 7 with the indoor unit; an outdoor-connection pipe 14 for connecting the four-way valve 7 with the outdoor heat exchanger 2; and concentrated mass 16 for reducing vibration of the absorption pipe 11. Also, on the part where the indoor-connection pipe 13 is projected, in its end, to the outside of the outdoor unit, a service valve 15 is formed.

For formation of a proper length, the absorption pipe 11 is projected approximately on the upper side of the compressor 1, extended toward the lower side of the compressor, and bent toward the upper side again, to be formed in an upward-rising shape.

The absorption pipe 11 is looped approximately at the up and down parts of the compressor in this manner, and the absorption pipe 11 of more than a predetermined length can be obtained. By having the absorption pipe 11 looped in the up-down direction, delivering force generated at the compressor and transferred by way of the absorption pipe 11 can be properly reduced. The present invention suggests the absorption pipe of a proper shape and length, capable of suppressing superposition/interference of vibration at the absorption pipe 11 and resonance occurring at the absorption pipe 11 due to vibration of the compressor, transferred to the absorption pipe 11.

Figure 2:
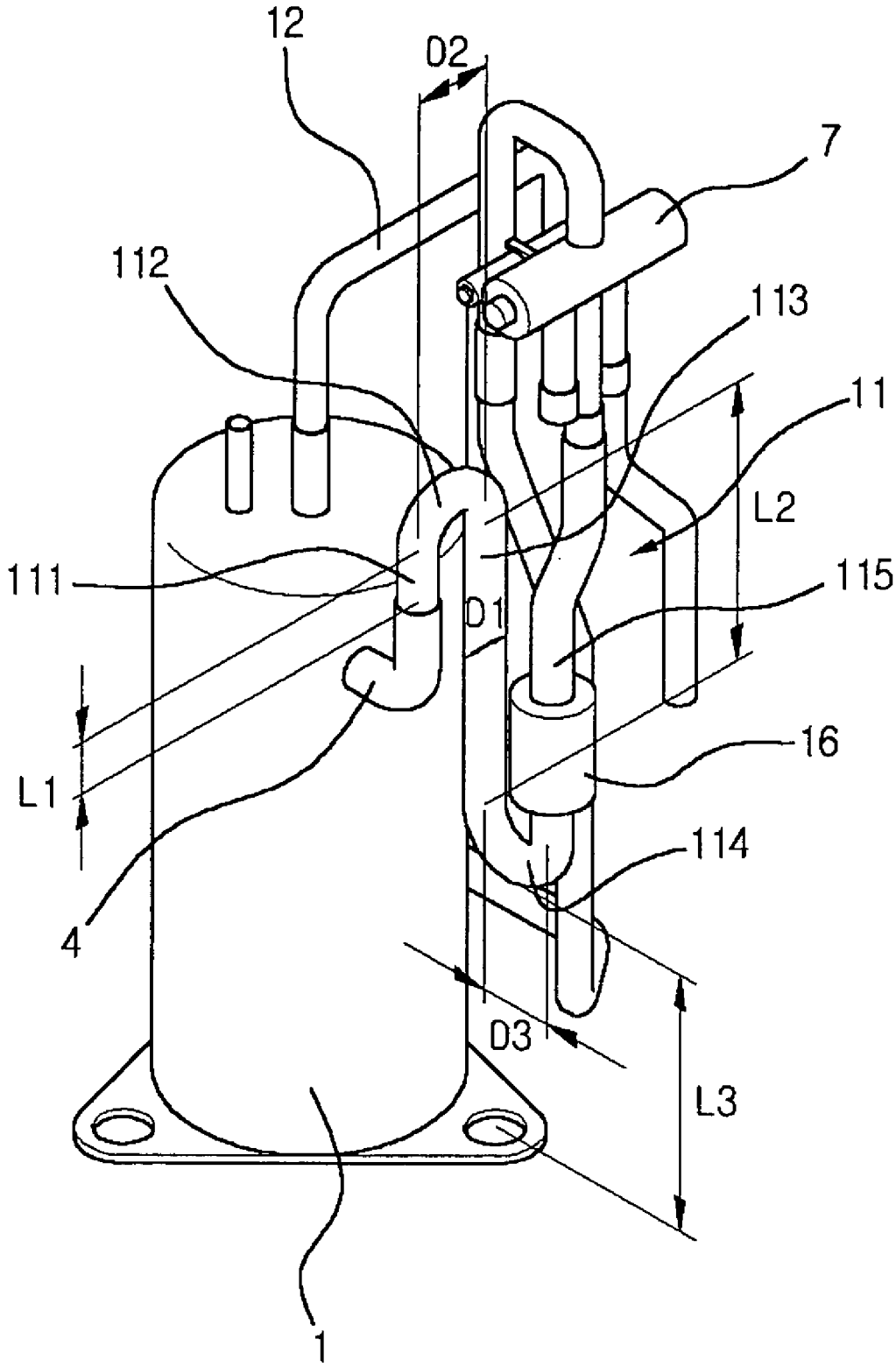
FIG. 2 is a drawing showing in detail a construction related to the compressor and the absorption pipe connected to the compressor in FIG. 1.
Figure 3:
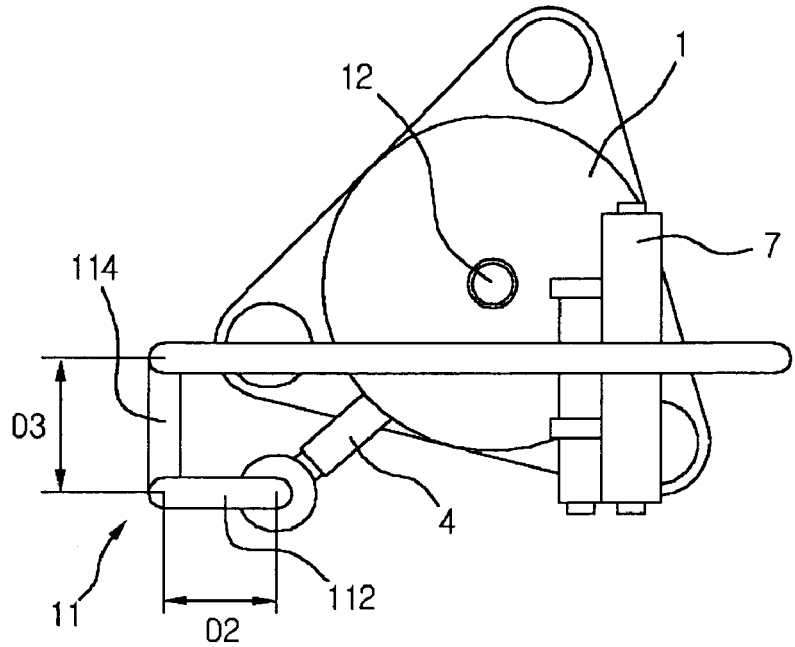
FIG. 3 is a plan view of a construction related to the compressor and the absorption pipe connected to the compressor in FIG. 1.
Figure 4:
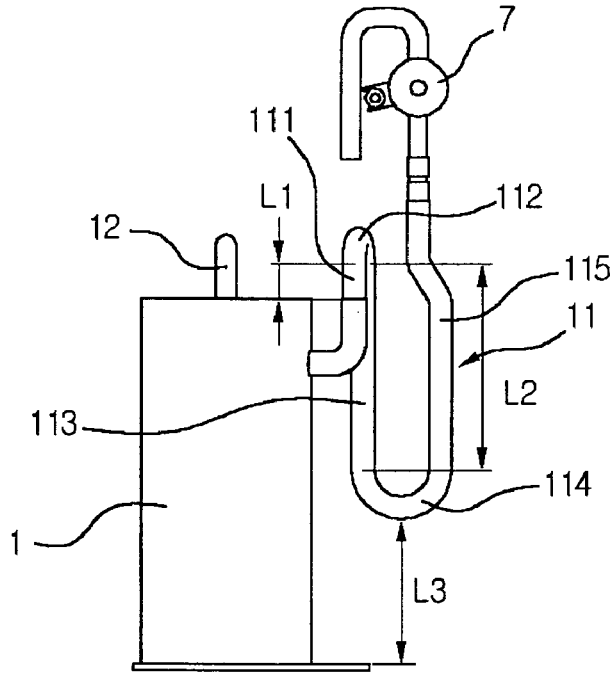
FIG. 4 is a side view of a construction related to the compressor and the absorption pipe connected to the compressor in FIG. 1.

FIG. 2 is a drawing showing in detail a construction related to the compressor and the absorption pipe connected to the compressor in FIG. 1, FIG. 3 is a plan view of a construction related to the compressor and the absorption pipe connected to the compressor, and FIG. 4 is a side view of a construction related to the compressor and the absorption pipe connected to the compressor.

Referring to FIGS. 2 through 4, a compressor 1; an absorption port 4 for guiding a refrigerant into the inside of the compressor 1; an absorption pipe 11 for connecting the absorption port 4 with the four-way valve 7 so that a refrigerant may be absorbed into the inside of the compressor 1; a discharging pipe 12 for discharging the compressed refrigerant from the compressor 11 to the four-way valve 7, are provided. Also, for a vibration reducing member formed on a predetermined position of the absorption pipe 11, for reducing vibration of the absorption pipe 11, concentrated mass 16 is provided. Here, the absorption pipe 11 includes: a first straight pipe part 111 connected with the absorption port 4 on the whole and extended straight-upward direction; an upper curved part 112 bent toward the lower side from an end of the straight pipe part 111; a second straight pipe part 113 extended to the lower side from the upper curved part 112; a lower curved part 114 bent again toward the upper side from a lower end of the second straight pipe part 113; and a third straight pipe part 115 extended to the upper side from the lower curved part 114. One end of the third straight pipe part 115 is connected with the four-way valve 7 so that a refrigerant may flow inside the conduit line. Also, the lower curved part 114 is looped in other direction different from the direction of the upper curved part 112, e.g., in a direction perpendicular to the direction of the upper curved part 112, so that vibration may be counterbalanced.

To suppress vibration and noise occurring at the absorption pipe 11 and properly form the shape and the size of the absorption pipe 11, the present invention suggests a length L1 of the first straight pipe part 111, a diameter D2 of the upper curved part 112, a diameter D3 of the lower curved part 114. To confine a length of the second straight pipe part 113, the present invention suggests correlation between the lowest height L3 of the absorption pipe 11 and the whole height of the compressor.

As already described, if the whole length of the absorption pipe 11 is long, delivering force is reduced, but vibration/noise such as resonance due to vibration transferred from the compressor 1 to the absorption pipe 11 is rather increased. Also, it is needless to say that as the length of the absorption pipe 11 gets long, manufacturing costs is increased as much as that. Also, since a space occupied by the outdoor unit gets big, the volume of the outdoor unit itself gets big.

The length L1 of the first straight pipe part 111 is limited below four times the diameter D1 of the absorption pipe. If the length of the first straight pipe part 111 is excessively long, vibration cannot be attenuated. Also, if the length of the first straight pipe part 111 is less than the diameter D1 of the absorption pipe, a process for connecting the absorption pipe 11 is difficult, which is not desirable.

The diameter D2 of the upper curved part 112 is limited below three times the diameter D1 of the absorption pipe. If the diameter D2 of the upper curved part 112 is too big, since a distance between the compressor 1 and the end of the upper curved part 112 gets too long, rotational vibration of the compressor 1 is transferred to the absorption pipe 11 too much, therefore, the possibility that vibration is amplified gets increased as much as that, and the upper curved part 112 moves as a rigid body, whereby vibration reduction effect may become reduced. On the contrary, if the diameter D2 of the upper curved part 112 is limited below the diameter D1 of the absorption pipe, a flow of a refrigerant flowing inside the conduit line of the absorption pipe is not swift, which is not desirable.

To reduce the length L2 of the second straight pipe part 113 to form the length L2 within a proper range, the lower end of the lower curved part 114 is positioned at the height of more than one third of the whole height of the compressor. By positioning the height L3 of the lower end of the lower curved part 114, at the height of more than a predetermined level, the whole length of the second straight pipe part 113 is limited below a predetermined level. The reason why the length of the second straight pipe part 113 is limited, is that if the length of the second straight pipe part 113 is long, vibration originating from right-left translational motion of the compressor 1 is transferred even much more and amplified, which is not desirable. Also, if the height L3 of the lower end of the lower curved part 114 is positioned at the position of more than three fourth of the compressor, the place at which the concentrated mass 16 is installed cannot be obtained, delivering force of the compressor is directly transferred to the four-way valve 7, and vibration of the outdoor unit itself gets big, which is not undesirable.

The diameter D3 of the lower curved part 114 is limited below three times the diameter D1 of the absorption pipe. If the diameter D3 of the lower curved part 114 is too big, the lower curved part 114 moves as a rigid body, whereby vibration attenuation effect which can be obtained at the looped portion may not be obtained. Also, if the diameter D3 of the lower curved part 114 is limited below the diameter D of the absorption pipe, a flow of a refrigerant flowing inside the conduit line of the absorption pipe is not swift, which is not desirable.

Figure 5:
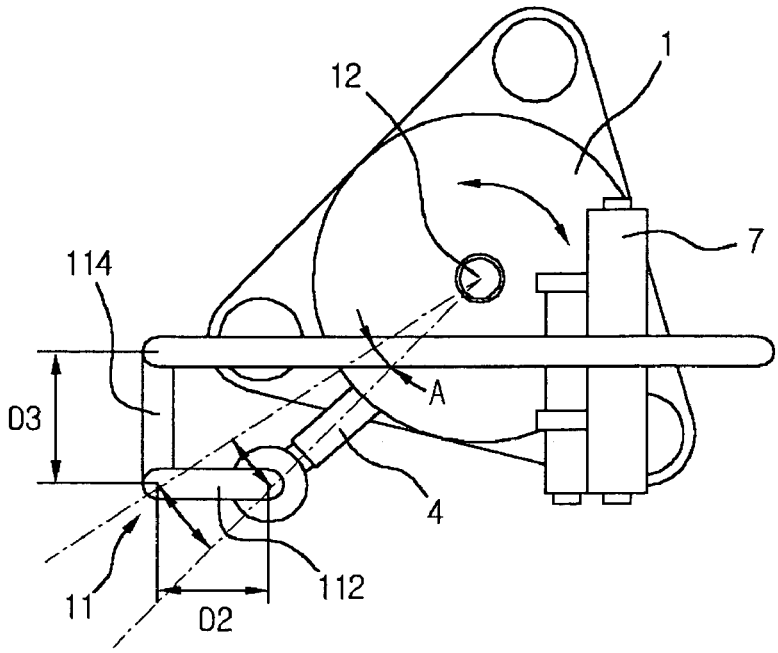
FIG. 5 is a drawing explaining a delivering state of rotational vibration of the compressor.

FIG. 5 is a drawing explaining a delivering state of rotational vibration of the compressor.

Referring to FIG. 5, the more farther the position of the absorption pipe 11 is distant from the center of the compressor 1, the bigger is the displacement of the absorption pipe 11 due to rotational vibration of the compressor 1. In FIG. 5, it is observed that with respect to the same rotational displacement of the compressor, the farther the absorption pipe 11 is distant away from the center of the compressor 1, the more becomes vibration angle A at the conduit line of the absorption pipe 11.

It will be easily understood by a person of an ordinary skill in the art that, under such a state, since the bigger are diameters of the upper and lower curved parts 112 and 114, the farther is the distance between the absorption pipe 11 and the center of the compressor 1, such limitation in diameters is not desirable.

Figure 6:
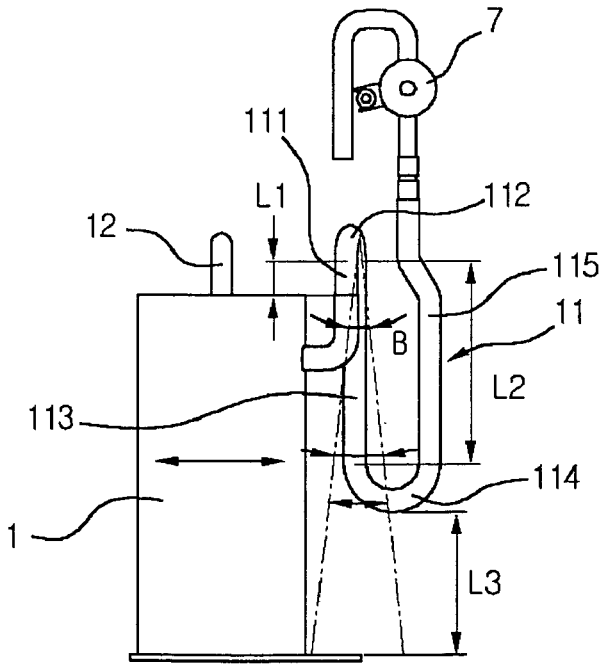
FIG. 6 is a drawing explaining a delivering state of a right-left translational vibration of the compressor.

FIG. 6 is a drawing explaining a delivering state of a right-left translational vibration of the compressor.

Referring to FIG. 6, it is observed that when the compressor moves right and left, if the length extended from a predetermined point positioned close to the compressor, to the lower side, is long, the displacement of the conduit line of the absorption pipe 11, originated from right-left translational motion of the same compressor, is increased. It will be easily understood by a person of an ordinary skill in the art that, under such a state, since the longer are the lengths of the first and the second straight pipe parts 111 and 113, the greater are the displacements of the straight pipe parts 111 and 113, a vibration angle B of the absorption pipe is increased.

It is noted that the above-described absorption structure of the compressor is applied not only to the outdoor unit of the heat hump, which is the general cooling/heating system, but also to an outdoor unit of an air conditioner for cooling operation, an outdoor unit of a multi-type air conditioner, and an outdoor unit of an air conditioner having an accumulator as well.

The absorption pipe structure of the outdoor unit in the air conditioner according to the sprit of the present invention, can reduce vibration concentrated on the conventional absorption pipe, by designing the looping length of the absorption pipe short as much as possible within the range where compressor vibration suppression effect is maximized. Also, the present invention can reduce resonance that might occur at the absorption pipe and noise due to displacement.

By forming short the looping length of the absorption pipe as described above, use space of the machinery room where the compressor is installed and the size of the outdoor unit are reduced, so that the outdoor unit can be constructed in a compact manner on the whole. Also, the material cost for manufacturing the absorption pipe is reduced, whereby cost reduction can be achieved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An absorption pipe structure for reducing vibration of a compressor, the structure comprising:

a four-way valve for switching between a cooling and a heating operation of an air conditioner; and an absorption pipe for supplying a refrigerant to the compressor from the four-way valve, the absorption pipe comprising at least one looped section that is configured to have its lowest end located at a position that corresponds to one third of the whole height of the compressor.

2. The absorption pipe structure according to claim 1, wherein the absorption pipe comprises a single body having an absorption port.

3. The absorption pipe structure according to claim 1, wherein the absorption pipe has a curved part at at least two points thereof.

4. The absorption pipe structure according to claim 1, further comprising a vibration reducing member fixed at at least one point of the absorption pipe.

5. The absorption pipe structure according to claim 1, wherein the absorption pipe comprises:

a first straight pipe part for connecting with the compressor;

a first curved part looped and extending from the first straight pipe part;

a second straight pipe part extending from the first curved part;

a second curved part looped and extending from the second straight pipe part; and a third straight pipe part extending from the second curved part.

6. The absorption pipe structure according to claim 1, wherein a length of a straight pipe part of the absorption pine, which is closest to the compressor is less than four times a diameter of the absorption pipe.

7. The absorption pipe structure according to claim 6, wherein the straight pipe part is configured to extend upward in parallel with a longitudinal direction of the compressor.

8. The absorption pipe structure according to claim 1, wherein a diameter of a loop formed by a curved part of the absorption pipe is less than three times a diameter of the absorption pipe.

9. The absorption pipe structure according to claim 1, wherein the absorption pipe structure is connected to the compressor.

10. The absorption pipe structure according to claim 1, wherein the absorption pipe comprises:

a first straight pipe part configured to extend upward from the compressor; and a second straight pipe part configured to extend in a direction opposite to a direction of the first straight pipe part.

11. An absorption pipe structure for reducing vibration of a compressor comprising:

a refrigerant supplying part for supplying a refrigerant to the compressor; and an absorption pipe for connecting the compressor with the refrigerant supplying part, the absorption pipe comprising at least one curved part, wherein a diameter of a loon formed by the curved part is less than three times a diameter of the absorption pipe.

12. The absorption pipe structure according to claim 11, the absorption pipe comprising at least two curved parts that have angles of curvature perpendicular to each other.

13. The absorption pipe structure according to claim 11, further comprising a straight pipe part formed at a connection portion between the absorption pipe and the compressor.

14. The absorption pipe structure according to claim 11, further comprising a first straight pipe part configured to extend upward in parallel with the compressor, the first straight pipe part formed at a connection part where the absorption pipe is connected with the compressor.

15. The absorption pipe structure according to claim 11, further comprising a first straight pipe part comprising a length less than four times a diameter of the absorption pipe.

16. The absorption pipe structure according to claim 11, wherein a curved part is formed at at least two locations along a length of the absorption pipe.

17. The absorption pipe structure according to claim 11, further comprising two curved parts, wherein the curved parts are curved in directions perpendicular to each other.

18. An absorption pipe structure for reducing vibration of a compressor, the structure comprising:

a refrigerant supplying part for supplying a refrigerant to the compressor; and an absorption pipe for connecting the compressor with the refrigerant supplying part, the absorption pipe comprising at least one part that is looped and at least one part that is straight, the straight part being configured to have a length that is less than four times a diameter of the absorption pipe.

19. The absorption pipe structure according to claim 18, wherein a lowest extent of the absorption pipe is a height of more than one third of the compressor.

20. The absorption pipe structure according to claim 18, the absorption pipe comprising a curved part looped at more than one place and a diameter of a loop of the curved part configured to be less than three times a diameter of the absorption pipe.

* * * * *

UNITED STATES PATENT AND TRADEMARK OFFICE

CERTIFICATE OF CORRECTION

PATENT NO. : 7,124,599 B2
APPLICATION NO. : 10/943104
DATED : October 24, 2006
INVENTOR(S) : Jung et al.

It is certified that error appears in the above-identified patent and that said Letters Patent is hereby corrected as shown below:

At column 7, line 27 (claim 11, line 8) of the printed patent, “loon” should be --loop--.

Signed and Sealed this

Fifteenth Day of January, 2008

JON W. DUDAS
*Director of the United States Patent and Trademark Office*